US010240368B2

(12) United States Patent
Necchi

(10) Patent No.: US 10,240,368 B2
(45) Date of Patent: Mar. 26, 2019

(54) ANTI-THEFT AND SAFETY MECHANISM FOR BOTTLES

(71) Applicant: Enneffe S.r.l., Valenza (IT)

(72) Inventor: Piero Necchi, Valenza (IT)

(73) Assignee: Enneffe S.R.L., Valenza (IT)

( * ) Notice: Subject to any disclaimer, the term of this patent is extended or adjusted under 35 U.S.C. 154(b) by 18 days.

(21) Appl. No.: 15/536,678

(22) PCT Filed: Nov. 23, 2015

(86) PCT No.: PCT/IT2015/000283

§ 371 (c)(1),
(2) Date: Jun. 16, 2017

(87) PCT Pub. No.: WO2016/098136

PCT Pub. Date: Jun. 23, 2016

(65) Prior Publication Data

US 2017/0342745 A1 Nov. 30, 2017

(30) Foreign Application Priority Data

Dec. 18, 2014 (IT) ..... TO2014A1064

(51) Int. Cl.

| | |
|---|---|
| ***E05B 73/00*** | (2006.01) |
| ***B65D 55/02*** | (2006.01) |
| *E05B 15/00* | (2006.01) |

(52) U.S. Cl.

CPC ..... *E05B 73/0041* (2013.01); *B65D 55/02* (2013.01); *E05B 73/0052* (2013.01); *E05B 15/0046* (2013.01)

(58) Field of Classification Search

CPC .. E05B 73/0041; E05B 73/0052; B65D 55/02

(Continued)

(56) References Cited

U.S. PATENT DOCUMENTS 445,755 A * 2/1891 King ..... B65D 55/14 215/207
833,446 A * 10/1906 Degener ..... B65D 55/14 215/207

(Continued)

FOREIGN PATENT DOCUMENTS

| | | |
|---|---|---|
| CN | 203499390 U | 3/2014 |
| EP | 2860334 A2 | 4/2015 |
| WO | WO-2006033124 A1 | 3/2006 |

OTHER PUBLICATIONS

International Search Report and Written Opinion for PCT/IT2015/000283, dated May 3, 2016; ISA/EP.

*Primary Examiner* — Suzanne L Barrett
(74) *Attorney, Agent, or Firm* — Harness, Dickey & Pierce, P.L.C.

(57) ABSTRACT

An anti-theft and safety mechanism for bottles is described, comprising a case, first locking and unlocking means, and second locking and unlocking means adapted to be actuated, when locking, through a manual action, after the mechanism has been inserted onto the neck of a bottle and, when unlocking, as consequence of the unlocking action exerted on the first locking and unlocking means, allowing the removal of the mechanism from the neck of the bottle, wherein the first locking and unlocking means comprise a hook which is adapted to fasten a collar of the bottle, and the second locking and unlocking means comprise a first half-circular element adapted to be moved in contact with the neck of the bottle preventing the access to the tip of the hook.

13 Claims, 4 Drawing Sheets

(58) Field of Classification Search
USPC ..... 70/57.1; 215/207, 201, 215
See application file for complete search history.

(56) References Cited

U.S. PATENT DOCUMENTS

| | | | | | |
|---|---|---|---|---|---|
| 880,723 | A * | 3/1908 | Cumming | B65D 55/14 | 215/207 |
| 3,930,388 | A * | 1/1976 | Barras | B60K 15/05 | 220/210 |
| 3,973,687 | A * | 8/1976 | Glick | B65D 55/14 | 215/207 |
| 5,464,109 | A * | 11/1995 | Greenwald | B65D 55/14 | 215/207 |
| 5,602,530 | A | 2/1997 | Holmgren | | |
| 5,714,807 | A * | 2/1998 | Albanes | B60R 25/06 | 180/287 |
| 7,372,363 | B2 * | 5/2008 | Durbin | E05B 73/00 | 215/201 |
| 7,570,161 | B2 * | 8/2009 | Necchi | B65D 50/067 | 215/201 |
| 8,607,601 | B1 * | 12/2013 | Wickesberg | B65D 55/14 | 70/15 |
| 8,950,609 | B2 * | 2/2015 | Aneas | B65D 51/002 | 215/247 |
| 9,472,073 | B2 * | 10/2016 | Yang | E05B 73/0041 | |
| 9,576,453 | B2 * | 2/2017 | Strassburger | B65D 23/14 | |
| 2004/0163430 | A1 | 8/2004 | Belden | | |
| 2005/0144992 | A1 | 7/2005 | Belden | | |
| 2005/0237205 | A1 * | 10/2005 | Gorst | B65D 55/00 | 340/572.9 |
| 2006/0170559 | A1 * | 8/2006 | Marsilio | E05B 73/0017 | 340/572.9 |
| 2008/0156764 | A1 | 7/2008 | Necchi | | |
| 2009/0152230 | A1 * | 6/2009 | Belden, Jr. | E05B 73/0017 | 215/221 |
| 2010/0287998 | A1 * | 11/2010 | Anderson | E05B 73/0017 | 70/57.1 |
| 2011/0219828 | A1 * | 9/2011 | Zhang | E05B 73/0017 | 70/58 |
| 2012/0152883 | A1 | 6/2012 | Zhang et al. | | |
| 2013/0321153 | A1 * | 12/2013 | Yang | G08B 13/2434 | 340/572.1 |
| 2015/0096334 | A1 | 4/2015 | Shi | | |

* cited by examiner

ANTI-THEFT AND SAFETY MECHANISM FOR BOTTLES

CROSS REFERENCE TO RELATED APPLICATIONS

This application is a U.S. National Phase Application under 35 U.S.C. 371 of International Application No. PCT/IT2015/000283 filed on Nov. 23, 2015 and published as WO 2016/098136 A1 on Jun. 23, 2016. This application claims priority to Italian Application No. TO2014A001064 filed on Dec. 18, 2014. The entire disclosures of all of the above applications are incorporated herein by reference.

The present invention refers to an anti-theft and safety mechanism for bottles.

Anti-theft mechanisms are known, typically with a magnetic operation, adapted to contain therein objects offered for sales, such as compact discs, DVDs, musicassettes, videocassettes and the like, or applied outside various items, such as, for example, glasses and clothes.

These mechanisms are typically activated on the product to be protected, when this latter one is exhibited for its sale, and are removed, generally through suitable magnetic or electromagnetic devices, upon the payment of the product itself.

However, such known mechanisms still have some inconveniences, one of which being that they can be removed relatively easily and with unspecialized tools, to be inserted between the mechanism itself and the neck of a bottle, for example, in order to disconnect the locking mechanism.

Documents US-A1-2012/152883 and CN-U-203 499 390 disclose anti-theft and safety mechanisms for bottles according to the preamble of claim 1.

Therefore, object of the present invention is solving the above prior art problems, by providing an anti-theft and safety mechanism, which allows obtaining a strong amount of safety against the unauthorized removal with respect to prior art mechanisms.

Another object of the present invention is providing an anti-theft and safety mechanism for bottles which can be applied, in an extremely simple and quick way, also with a single hand.

The above and other objects and advantages of the invention, as will result from the following description, are obtained with an anti-theft and safety mechanism for bottles, in compliance with claim 1, of the type comprising a case and first locking and unlocking means of such mechanism, contained inside the case, these first locking and unlocking means being adapted to be magnetically attracted by external magnetic or electromagnetic means to the case for unlocking the mechanism, wherein the first locking and unlocking means are adapted to be actuated, when locking, with the simple insertion of the mechanism on the neck of the bottle, second locking and unlocking means being provided, which are adapted to be actuated, when locking, through a manual action, after such mechanism has been inserted on the neck of the bottle and, when unlocking, as consequence of the unlocking action exerted with the magnetic or electromagnetic means on the first locking and unlocking means, so that the only application of the external magnetic or electromagnetic means generates the complete unlocking of the first and second locking and unlocking means, allowing the removal of the mechanism from the bottle neck.

Preferred embodiment and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) could be made to what is described, without departing from the scope of the invention, as will appear from the enclosed claims.

The present invention will be better described by some preferred embodiments thereof, provided as a non-limiting example, with reference to the enclosed drawings, in which.

Figure 1:
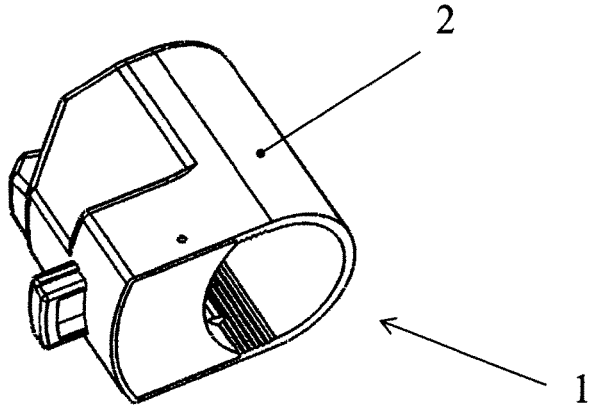
FIG. 1 is a perspective view of an anti-theft and safety mechanism for bottles according to the present invention.
Figure 2:
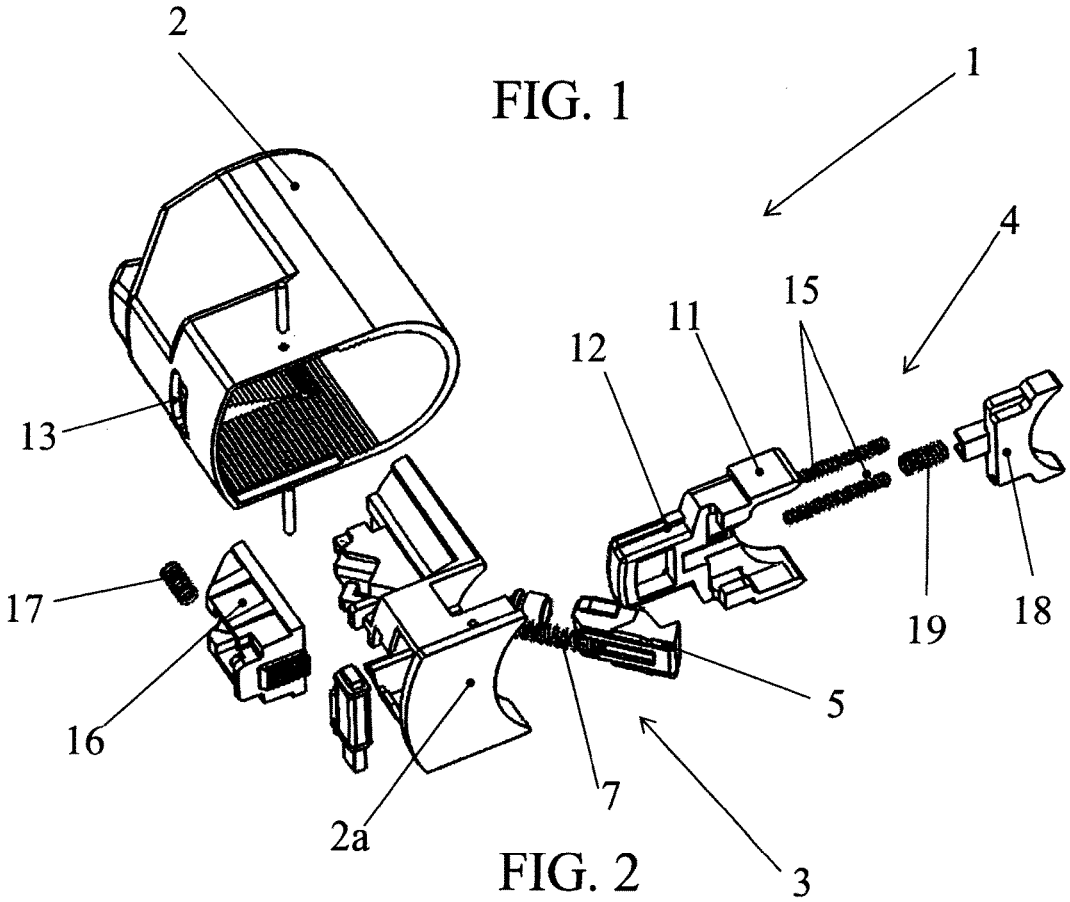
FIG. 2 is an exploded perspective view of the anti-theft and safety mechanism for bottles of FIG. 1.
Figure 3:
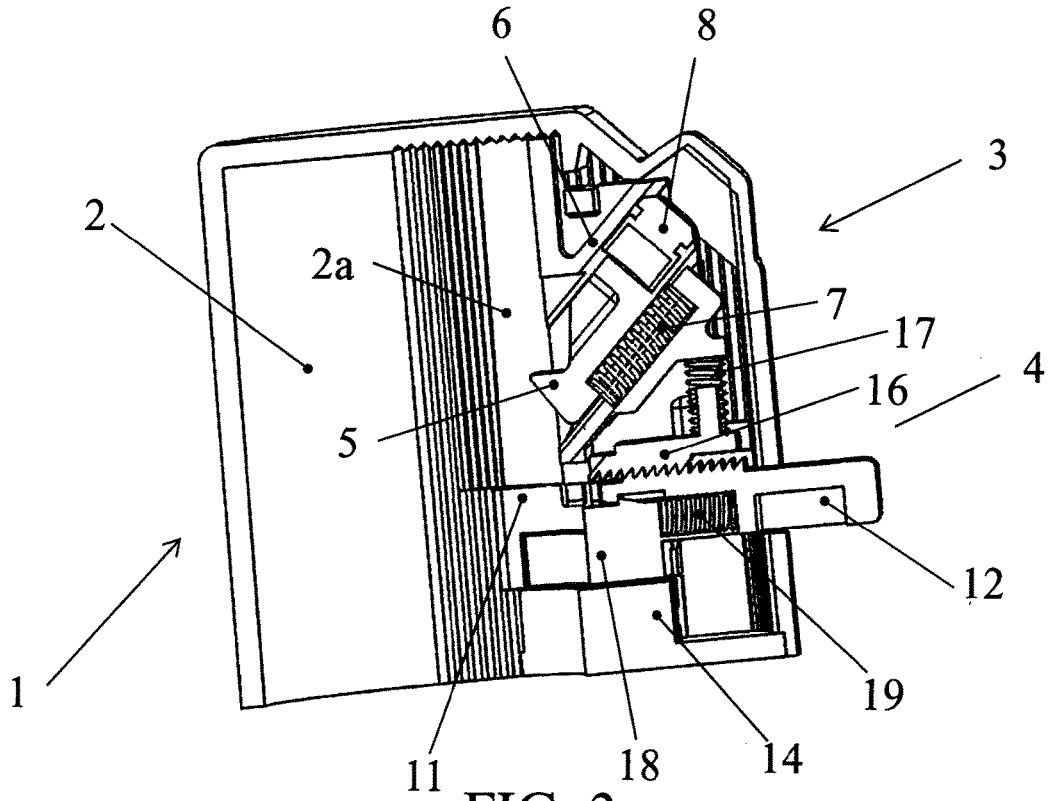
FIGS. 3 and 4 are two sectional views of the anti-theft and safety mechanism for bottles according to the present invention.
Figure 4:
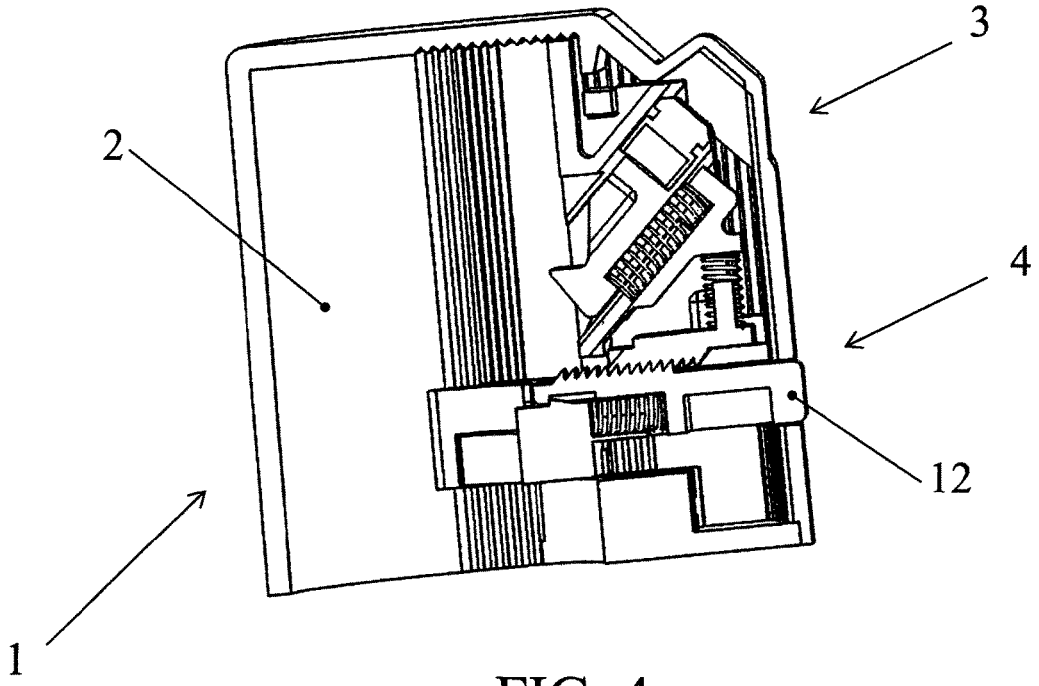

With reference to FIGS. 1 and 2, reference number 1 designates a preferred, but not limiting, embodiment of an anti-theft and safety mechanism for bottles, according to the invention.

With reference to the preferred embodiment shown in the Figures, the mechanism 1 substantially comprises a case 2 inside which first locking and unlocking means 3 and second locking and unlocking means 4 are contained.

The first locking and unlocking means 3 are adapted to be actuated, when locking, with the simple insertion of the mechanism 1 on the neck of the bottle and, when unlocking, through an action exerted from outside, with magnetic or electromagnetic means.

The second locking and unlocking means 4 are adapted to be actuated, when locking, through a manual action, after the mechanism 1 has been inserted on the neck of the bottle, and, when unlocking, as consequence of the unlocking action exerted with the magnetic or electromagnetic means on said first locking and unlocking means 3.

The first locking and unlocking means 3 comprise a hook 5, sliding on guides 6 obtained in a support 2*a* which is inserted into the case 2. The hook 5 is subjected to the action of elastic means, for example a helical spring 7, which counteract the backward movement of such hook 5 when a thrust is exerted onto the tip of the hook 5, as will be better described below. On the back of the hook 5 an element 8 made of ferromagnetic material, fr example iron, is made integral, which element 8, subjected to the action of magnetic or electromagnetic means of a known type (not shown), makes the hook 5 move backward, winning the reaction of the helical spring 7.

In order to allow an easy sliding of the hook 5 due to the thrust of the collar 10 of the bottle 9, it is preferable that the sliding of the hook 5 occurs on a plane comprising the axis of the neck of the bottle 9 and is slanted by an angle of about 45° with respect to the axis of the neck of the bottle 9.

The second locking and unlocking means 4 comprise a first half-circular element 11, integral with a push-button 12 which is inserted into an opening 13 made on the case 2. The first half-circular element 11 is sliding on guides 14 obtained in the support 2*a* inserted in the case 2 and is subjected to the action of elastic means which counteract its backward movement, for example two helical springs 15. A toothing is obtained on a side of the push-button 12, which toothing engages a corresponding toothing obtained on an element 16, sliding transversally to said push-button 12 and subjected to the action of elastic means, for example a helical spring 17. The shape of the tooth is such as to allow the sliding of the push-button due to a thrust applied in order to push it towards the neck of the bottle 9, but to prevent its return due to the only reaction of the helical springs 15.

The element 16 is shaped in such a way that, when the hook 5 moves backward due to the action exerted thereon by the ferromagnetic element 8, subjected to the action of magnetic or electromagnetic unlocking means, the element 16 moves away from the push-button 12, winning the reaction of the helical spring 17, thereby unlocking the push-button 12.

According to a preferred embodiment, the use of a second half-circular element 18 is provided, sliding substantially together with the first half-circular element 11 and, therefore, adapted to be actuated through the push-button 12, but further sliding axially with respect to said push-button 12 and subjected to the action of elastic means, for example a helical spring 19 which tends to compress it against the neck of the bottle 9.

For a correct operation of the semi-circular element 11, actuated by the push-button 12, it is advisable that the sliding axis is perpendicular with the neck of the bottle 9. Moreover, for a correct operation of the push-button 12 itself as regards the toothed element 16, it is advisable that the sliding direction of the toothed element 16 and the sliding direction of the push-button 12 are coplanar. Definitely, for the correct operation of the whole mechanism, it is advisable that the sliding directions of all elements and the axis of the neck of the bottle 9 are coplanar.

Figure 5:
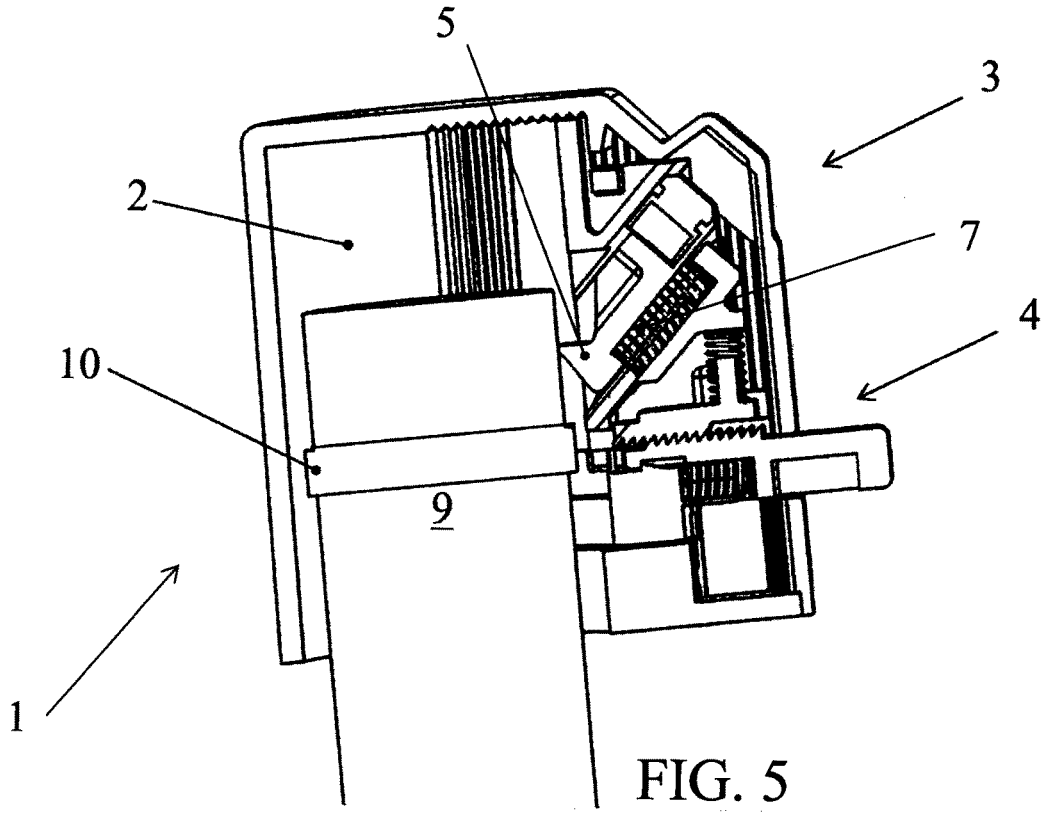
FIGS. 5, 6 and 7 show the insertion and locking procedure for a bottle through the mechanism according to the present invention.
Figure 6:
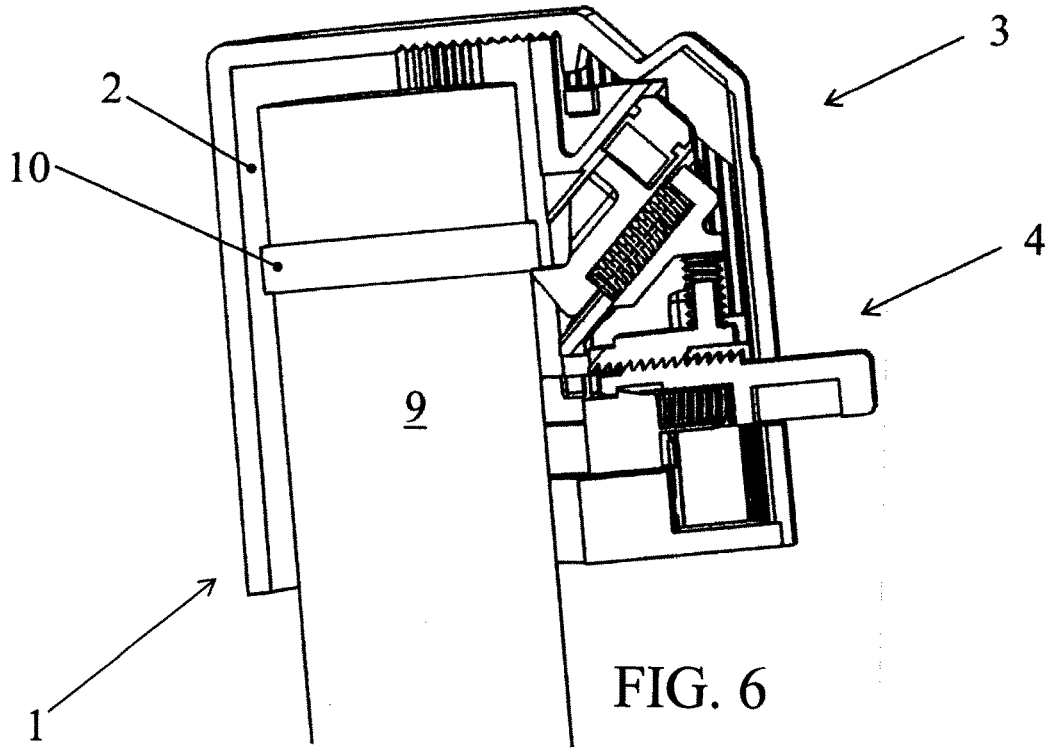
Figure 7:
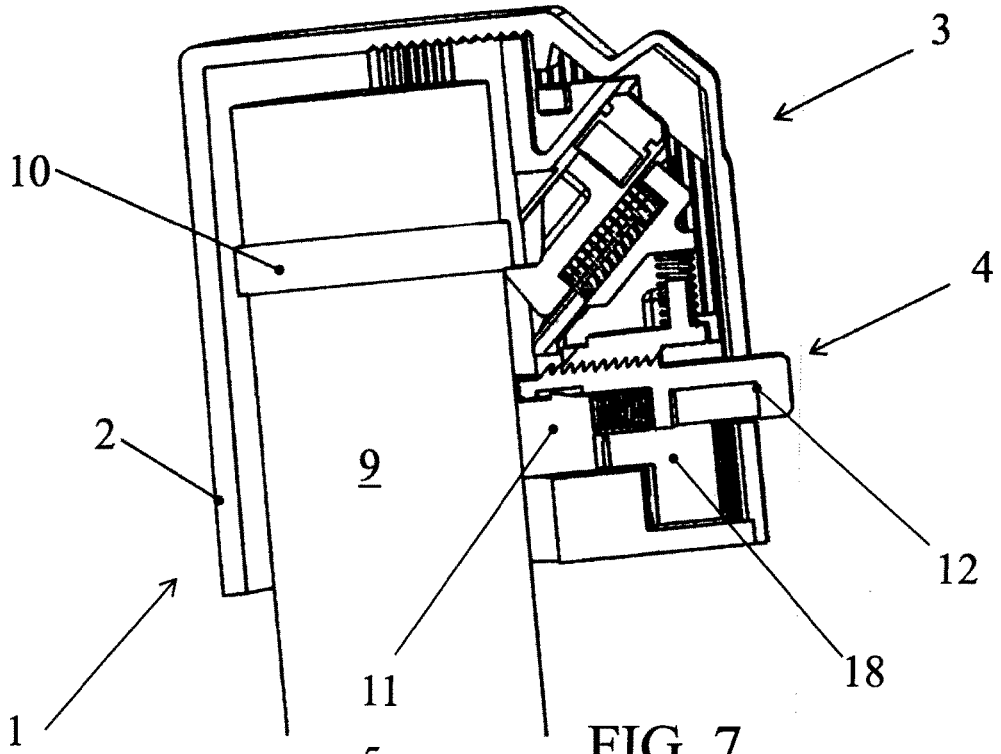

In practice, as shown in FIGS. 5 and 6, the anti-theft and safety mechanism 1 is inserted on the neck of a bottle 9 till a collar 10 of the bottle 9 presses on the hook 5 and makes it move backwards, winning the reaction of the helical spring 7. When the collar 10 of the bottle 9 has passed the tip of the hook 5, this latter one, pushed by the helical spring 7, again advances in order to block the neck of the bottle 9 inside the anti-theft and safety mechanism 1. Afterwards (as shown in particular in FIG. 7), by exerting a pressure onto the push-button 12, the half-circular elements 11 and 18 are taken in contact with the neck of the bottle 9, preventing the access to the tip of the hook 5.

Figure 8:
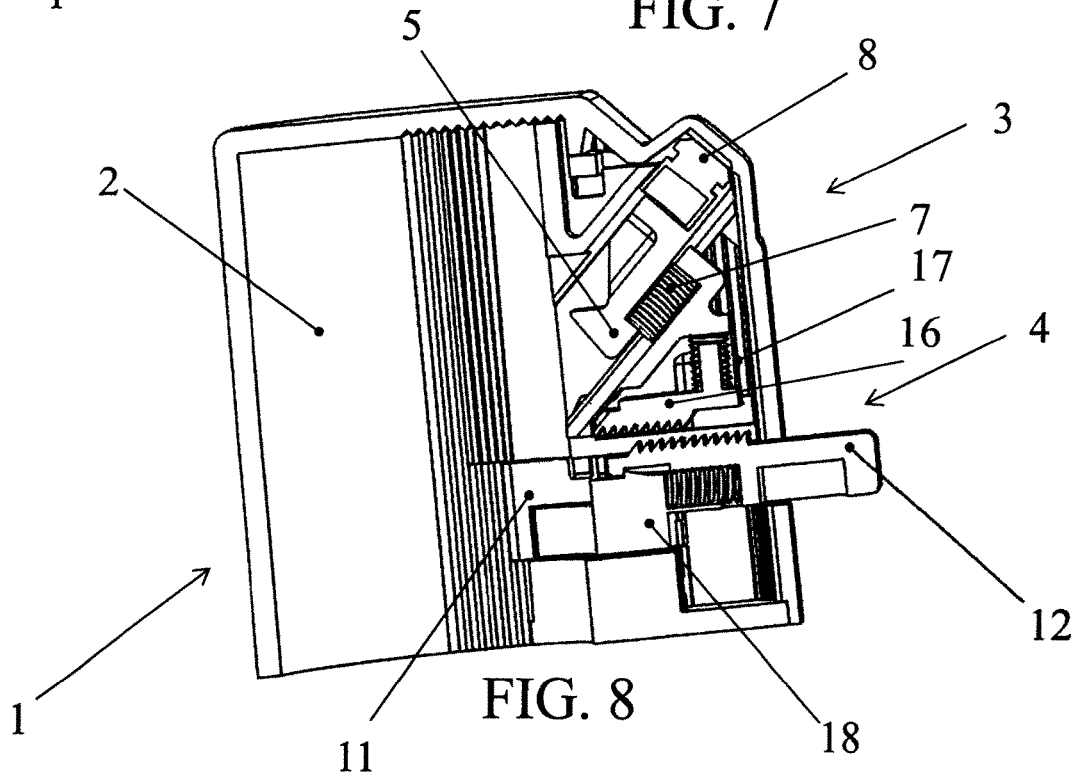
FIG. 8 shows a sectional view of the anti-theft and safety mechanism for bottles according to the present invention in its unlocking position.

By acting with magnetic or electromagnetic means on the ferromagnetic element 8 (as shown in particular in FIG. 8), the hook 5 moves backwards winning the reaction of the helical spring 7, interacts with the toothed element 16 which, by winning the reaction of the helical spring 17, unlocks the push-button 12 and the bottle 9 can be extracted.

Finally, in order to make the anti-theft action efficient, inside the case 2 at least one detecting system is advantageously placed, of the radiofrequency (RF), electromagnetic (EM) or acoustic-magnetic (AM) type with a ferrite core (not shown) or their combinations, cooperating with the anti-theft detecting barriers and/or at least one RFID element (not shown), according to the prior art.

The operation of the anti-theft and safety mechanism 1 of the invention will now be described, which is applied according to the following procedure:

placing the mechanism 1 on the neck of the bottle 9;

inserting the mechanism 1 on the neck of the bottle 9 till the hook 5 has passed the collar 10, thereby blocking the neck of the bottle 9 inside the case 2 of the mechanism 1;

sliding the push-button 12 towards the neck of the bottle so that the first half-circular element 11, and the second half-circular element 18, if present, are compressed against the neck of the bottle 9, such half-circular elements remaining pressed against the neck of the bottle 9 for engagement of the toothing of the side of the push-button 12 in the toothing of the toothed element 16.

As can be noted, the whole operation of application of the mechanism 1 to the neck of the bottle 9 can be performed by grasping the mechanism 1 with a single hand, inserting it onto the neck of the bottle 9 for actuating the hook 5 and pressing with the hand palm against the push-button 12 when the hook 5, pushed by the helical spring 7, snaps in order to block the collar 10.

Under this situation, it is not possible to tamper with the mechanism 1 in order to extract it from the bottle, since, due to the presence of the first half-circular element 11 and, possibly, of the second half-circular element 18, which are placed in front of the hook 5, the attempts of exerting a pressure onto the tip of the hook 5 to make it move backwards are inefficient.

The unlocking of the mechanism 1 can be performed with the external magnetic or electromagnetic means which, by acting on the ferromagnetic element 8, make the hook 5 go backwards, with the consequent unlocking of the collar 10 and the lifting of the toothed element 16. The lifting of the toothed element 16 generates the unlocking of the push-button 12 which, under the thrust of the helical springs 15, moves backwards, detaching the half-circular elements 11 and 18 from the neck of the bottle 9.

From the previous description, it is clear how the mechanism according to the present invention can be applied to any type and shape of bottles in such a way as to prevent possible thefts, and above all to already visually dissuade possible thieves, such mechanism being able to be easily and quickly removed, as occurs for existing anti-theft mechanisms, through its suitable detaching device. The mechanism according to the present invention is further adapted to prevent an accidental or unauthorized consumption of the contents of a bottle, as occurs, for example, when such contents are an obnoxious substance, a drug or an alcoholic beverage: such mechanism is therefore also extremely useful, for example, in a house in which, unfortunately to frequently, liquid detergents and various obnoxious substances (hydrocarbons, disinfectants, insecticides, alcoholic beverages) are placed in anonymous bottles, to avoid an accidental or unauthorized consumption or use of such substances.

The invention claimed is:

1. An anti-theft and safety mechanism for bottles, of the type comprising a case and first locking and unlocking means of said mechanism, contained inside said case, said first locking and unlocking means being adapted to be magnetically attracted by magnetic or electromagnetic means external to said case for unlocking said mechanism, second locking and unlocking means being provided which are adapted to be actuated, when locking, through a manual action, after said mechanism has been inserted onto the neck of said bottle and, when unlocking, as consequence of an unlocking action exerted with said magnetic or electromagnetic means onto said first locking and unlocking means, so that the only application of said external magnetic or electromagnetic means generates the complete unlocking of said first and second locking and unlocking means, allowing the removal of the mechanism from the neck of the bottle, wherein said first locking and unlocking means are adapted to be actuated, during the locking action, with only insertion of said mechanism onto the neck of said bottle and comprise a hook which is adapted to fasten a collar of said bottle, and the second locking and unlocking means comprise a first half-circular element adapted to be moved in contact with the neck of the bottle preventing the access to the tip of the hook.

2. The mechanism according to claim 1, wherein the hook of said first locking and unlocking means:

is sliding inside said case;

is subjected to the action of elastic means adapted to counteract the backwards movement of said hook when a thrust is exerted on the tip of said hook;

is made integral with an element made of ferromagnetic material which, subjected to the action of magnetic or electromagnetic means, makes said hook move backwards.

3. The mechanism according to claim 2, wherein said hook slides on guides obtained in a support which is inserted into said case.

4. The mechanism according to claim 2, wherein said elastic means, adapted to counteract the backwards movement of said hook comprise a helical spring.

5. The mechanism according to claim 1, wherein said first half-circular element of said second locking and unlocking means is integral with a push-button which:

is inserted into an opening obtained on said case;

is subjected to the action of elastic means adapted to move said push-button away from the neck of the bottle;

is equipped with a first toothing which engages a corresponding second toothing obtained on an element, sliding transversally to said push-button and subjected to the action of elastic means adapted to keep the engagement between said first and second toothing, the shape of the tooth being such as to allow the sliding of said push-button due to a thrust applied in order to push said push-button towards the neck of said bottle, but to prevent it from returning due to the only reaction of said elastic means.

6. The mechanism according to claim 5, wherein said push-button slides on guides obtained in said support.

7. The mechanism according to claim 5, wherein said elastic means, adapted to move said push-button away from the neck of the bottle comprise at least one helical spring.

8. The mechanism according to claim 5, wherein said elastic means comprise at least one helical spring.

9. The mechanism according to claim 5, wherein said push-button provides for the use of a second half-circular element, sliding substantially together with said first half-circular element, said second half-circular element being adapted to be actuated through said push-button, further sliding axially with respect to said push-button and subjected to the action of elastic means, adapted to compress said push-button against the neck of said bottle.

10. The mechanism according to claim 9, wherein said elastic means, adapted to compress said second half-circular element against the neck of said bottle, comprise a helical spring.

11. The mechanism according to claim 2, wherein the sliding directions of said hook, push-button and toothed element and the axis of the neck of said bottle are coplanar.

12. The mechanism according to claim 2, wherein the hook of said first locking and unlocking means is adapted to be unlocked through said external magnetic or electromagnetic means which, by acting on said ferromagnetic element, make said hook move backwards, with the consequent unlocking of said collar and the lifting of said toothed element, the lifting of said toothed element generating the unlocking of said push-button which, under the thrust of said elastic means, moves backwards, detaching said half-circular elements and from the neck of said bottle].

13. The mechanism according to claim 1, wherein the hook of said first locking and unlocking means has at least one detecting system of the radiofrequency, electromagnetic or acoustic-magnetic type with ferrite core or their combinations and/or at least one RFID element inside said case.

* * * * *